US007922348B2

(12) United States Patent
Razeto

(10) Patent No.: US 7,922,348 B2
(45) Date of Patent: Apr. 12, 2011

(54) LUMINOUS HANDLE FOR DOORS, FURNISHINGS, MEANS OF TRANSPORT OR THE LIKE

(75) Inventor: Giangiacomo Razeto, Sori (IT)

(73) Assignee: Razeto Design'N Innovation SRL, Genoa (IT)

( * ) Notice: Subject to any disclaimer, the term of this patent is extended or adjusted under 35 U.S.C. 154(b) by 95 days.

(21) Appl. No.: 12/161,929

(22) PCT Filed: Jan. 23, 2007

(86) PCT No.: PCT/EP2007/050667

§ 371 (c)(1),
(2), (4) Date: Oct. 21, 2008

(87) PCT Pub. No.: WO2007/082960

PCT Pub. Date: Jul. 26, 2007

(65) Prior Publication Data

US 2009/0046447 A1 Feb. 19, 2009

(30) Foreign Application Priority Data

Jan. 23, 2006 (EP) ..... 06100706

(51) Int. Cl.
*E05B 17/00* (2006.01)

(52) U.S. Cl. ..... 362/100; 72/432

(58) Field of Classification Search ..... 362/100; 70/432, 292, 74, 340

See application file for complete search history.

(56) References Cited

U.S. PATENT DOCUMENTS

| | | | | |
|---|---|---|---|---|
| 1,674,159 | A | 6/1928 | Cruys | |
| 2,256,670 | A | 9/1941 | Greenlees | |
| 4,777,570 | A * | 10/1988 | Littles | 362/100 |
| 5,398,175 | A * | 3/1995 | Pea | 362/100 |
| 5,597,227 | A * | 1/1997 | Bergen et al. | 362/551 |
| 5,839,817 | A * | 11/1998 | Wei | 362/192 |
| 5,904,232 | A * | 5/1999 | Shen | 192/69.62 |
| 5,996,383 | A * | 12/1999 | Adelmeyer et al. | 70/454 |
| 2004/0085755 | A1 * | 5/2004 | Dupont | 362/100 |

FOREIGN PATENT DOCUMENTS

| | | | |
|---|---|---|---|
| DE | 20220187 | U1 | 4/2003 |
| WO | 2004085771 | A1 | 10/2004 |

* cited by examiner

*Primary Examiner* — Julie A Shallenberger

(74) *Attorney, Agent, or Firm* — Stradley Ronon Stevens & Young, LLP

(57) ABSTRACT

A luminous handle (10) for doors, furnishings, or public buildings such as airports, toilets, hospitals, etc., means of transport or the like, comprising a handgrip or knob (20) made of transparent or translucent material, sanded if necessary. A spindle (8) with a definite section is intended to be inserted in a lock (24), through the latch present in the lock while a fixing screw or spring ball (12) is suitable to be fixed on said spindle (8) passing through the latch of the lock. The spindle (8) has an axial through hole positioned inside which is an electric conductor (4) electrically insulated from said spindle (8) by an insulating sleeve (9). The handgrip or knob (20) contains a LED or a luminous source of any type supplied by said electric conductor (4). The LED and the circuit can be inserted in the handle (10). The handle 10 is in contact with the handgrip or knob (20) inside which a chamber can be produced to allow diffusion of the light. The LED or luminous source of any type can also be positioned inside the handgrip or knob (20). The power supply is preferably obtained by an induction system (26, 28).

21 Claims, 4 Drawing Sheets

LUMINOUS HANDLE FOR DOORS, FURNISHINGS, MEANS OF TRANSPORT OR THE LIKE

FIELD OF THE INVENTION

The present invention relates to a luminous handle which can be applied to any type of lock or closing system, having one or more handles, of doors of any type, wardrobes and/or similar furnishings present in dwellings in communal use or public buildings such as airports, toilets, hospitals, etc. and also for doors and closures of any type applied to any type of transport vehicles, such as motor vehicles, watercraft of any type and tonnage.

STATE OF THE ART

Conventional locks, composed of closing mechanisms or locks and relative handle to open and close said mechanism and consequently open and close the relative door are known to all, above all in the fields of application mentioned above.

In order to make the mechanism comfortable and easy to open, the door commonly has a handgrip or knob with shape and dimensions suitable to be comfortably operated by the hand of the user. Said knob or handgrip can either be produced separately and marketed in various shapes and colours to satisfy the need for robustness and duration and also to the aesthetic tastes of users, or said handgrip or knob and handle can be produced in one piece.

Handles with handgrips or knobs made of various metals, including steel or alloys including brass and other compounds have been proposed. Other materials commonly used are plastics of any type, wood or even stone, such as onyx.

In order to make these handles visible even in conditions of poor visibility or in poorly lit environments, various solutions have been proposed, including incorporating phosphorescent or photoluminescent materials in the knobs or handgrips or handles, colouring them with a bright colour or providing said handles or knobs with light bulbs and producing the relative knob with a transparent or semi-transparent material.

Solutions of the last-mentioned type are present on the market, in which the handle houses on one side the power supply system composed of "penlight" batteries and on the other side the small light bulb or light emitting diode. Solutions without batteries are also available, connected to the power supply by conductors that pass through the door and receive power from the electric locks present in the door.

This type of embodiment has partly solved the problems mentioned, by providing a handle with a luminous knob illuminated by an internal light bulb supplied by a battery source.

However, the embodiment is complicated both from the point of view of production and of function: from the point of view of production the handle is produced in transparent or semi-transparent material and must be subsequently worked internally in order to house the batteries with the relative contacts and the illumination system. These operations are naturally burdensome from the point of view of time required and are not suitable for a large-scale and low-cost product. From the point of view of function, the solution described above has the noteworthy drawback of operation of the luminous handle depending on the residual availability of power stored in the batteries. It is clear that, although not consuming a considerable intensity of current, the light bulb or light emitting diode remains constantly switched on and this causes the batteries to discharge rapidly. In the case of batteries this makes their frequent replacement necessary; moreover, frequent removal and replacement of knobs to access the batteries causes damage to the knob in the long term.

Moreover, in more critical conditions of use, such as on transport vehicles, for example watercraft, where the atmosphere is more corrosive and there are considerable vibrations, this system has proved to be unreliable in the long term.

From the point of view of function, a second drawback is represented by the fact that handles or knobs of this type must be designed and produced ad hoc, meaning they differ from standard components and therefore are not easy to use on existing locks; consequently they are not an ideal solution to allow retrofitting of existing locks, thus considerably reducing the market of application.

DESCRIPTION OF THE INVENTION

The object of the present invention is therefore to overcome the aforesaid problems and to provide a luminous handle for doors, furnishings, or public buildings such as airports, toilets, hospitals, etc., means of transport or the like, which can be used without subsequent maintenance operations being required, and which is suitable to be used on any type of existing handle or lock.

A luminous handle for doors, furnishings, or public buildings such as airports, toilets, hospitals, etc., means of transport or the like, which answers this need is defined in claim 1. Further advantageous embodiments are defined in the dependent claims.

The luminous handle according to the present invention is characterised by the fact that it comprises a handgrip or knob made of transparent or translucent material, a spindle with a definite section (square, rectangular or circular) intended to be inserted in a lock comprising a latch, inside which said spindle passes and a fixing screw or spring ball which can be fixed on said spindle, wherein said spindle has an axial through hole positioned inside which is a conductor insulated from said spindle by an insulating sleeve and in that said handgrip or knob or said handle or said lock contains a LED or a luminous source of any type.

Preferably, the handle has an electric conductor, electrically insulated from said spindle and which supplies said LED or luminous source positioned in the handgrip or knob or in the handle.

Preferably, the handle has a groove with a definite section, intended to engage on said spindle, fitted inside which is an insulating sleeve which supports an electric conductor connected to said LED or luminous source of any type and a second conductor intended to make contact with said spindle.

It is convenient for said electric conductor or said spindle to have at the two ends, at the level of the end of the spindle, two spring tips intended to make electrical contact with said electric conductor and, if necessary, to vary the length of said spindle in order to adapt its length to different thicknesses of said door. Preferably, said electric conductor is constituted by a spring.

According to an embodiment of the invention, on the latch of the lock 24 a fixing screw 12 is threaded, intended to be screwed on said spindle 8 which supports a central conductor 18, said fixing screw comprising preferably an insulation 14 of the spindle 8 at the external ends of which a connection is provided for input of an electrical signal 2.

According to another embodiment of the invention, on the latch of the lock 24 a spring ball is threaded, which is intended to be engaged on said spindle 8 and wherein the thread of the latch is preferably provided with an insulation 14 of the spindle 12 which supports the spring ball at the external ends of which a connection is provided for input of an electrical signal 2.

An electric current to supply said LED or luminous source of any type can be distributed to said connection for input of an electrical signal.

A modulated electrical signal to control said LED or luminous source of any type, or any other information display, preferably liquid crystal, or for any other control of said lock, can also be distributed to said connection for input of an electrical signal.

Preferably, the electric current to supply said LED or luminous source of any type is obtained by an induction system.

It is advantageous for said induction system to comprise a primary connected to the electrical network and preferably fixed inside the wall or the frame of the door and a secondary, integral with the door, preferably positioned inside the door or preferably inside said lock so that it is not visible from the outside, said secondary being intended to recharge rechargeable batteries which supply the handle through an electric cable.

According to an embodiment of the invention, said LED or luminous source of any type is positioned in said latch of the lock and optical fibres which transport the light to said handgrip or knob are positioned inside said spindle.

The electrical current for said LED or luminous source is obtained from a system which is in electro-mechanically contact with the mobile part of the lock 24, said contact being intended to recharge rechargeable batteries 32 which supply the handle by means of an electrical cable 30. The electro-mechanical contact occurs between a striker plate on the door frame and a non-centred contact on the mobile part of the lock, and wherein the contact head on the mobile part preferably comprises a spring contact. A servo-lever set in action by the mobile part of the lock engages the striker plate on the door frame when the door is closed, compressing the contact (a) to the non-centred contact on the mobile part of the lock.

DETAILED DESCRIPTION OF THE FIGURES

FIG. 1 schematically shows a door with a handle according to the present invention;

Figure 2:
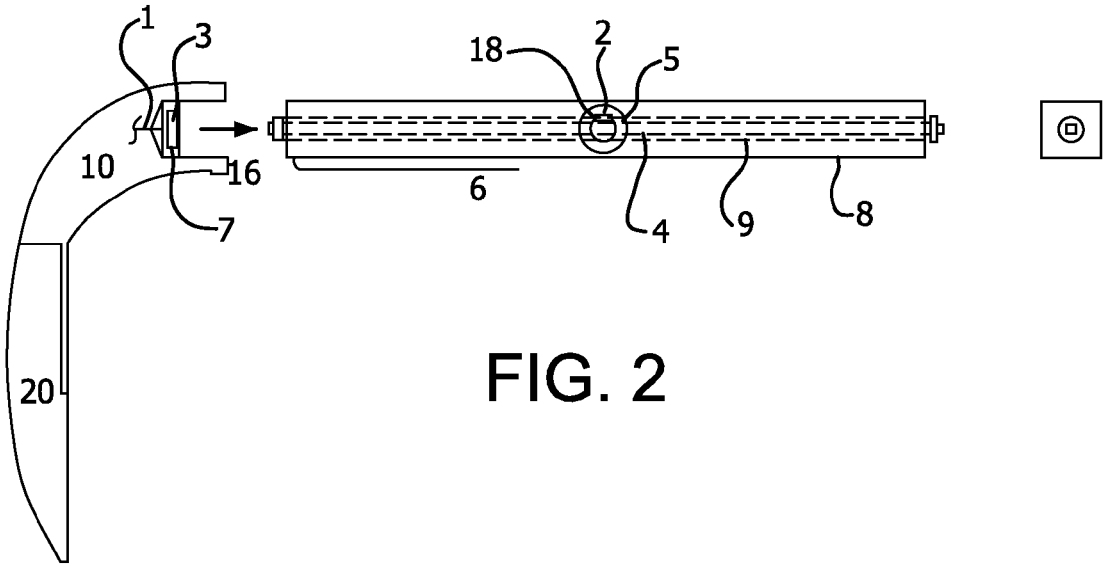
FIG. 2 shows a side view of the handle and part of the lock in question.
Figure 3:
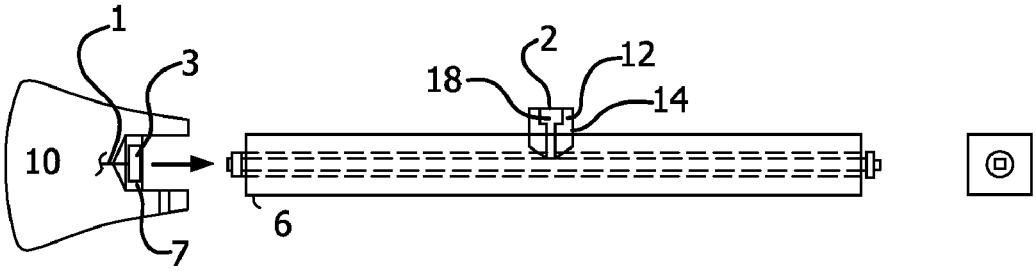
FIG. 3 shows a top view of the handle and part of the lock in question.
Figure 4:
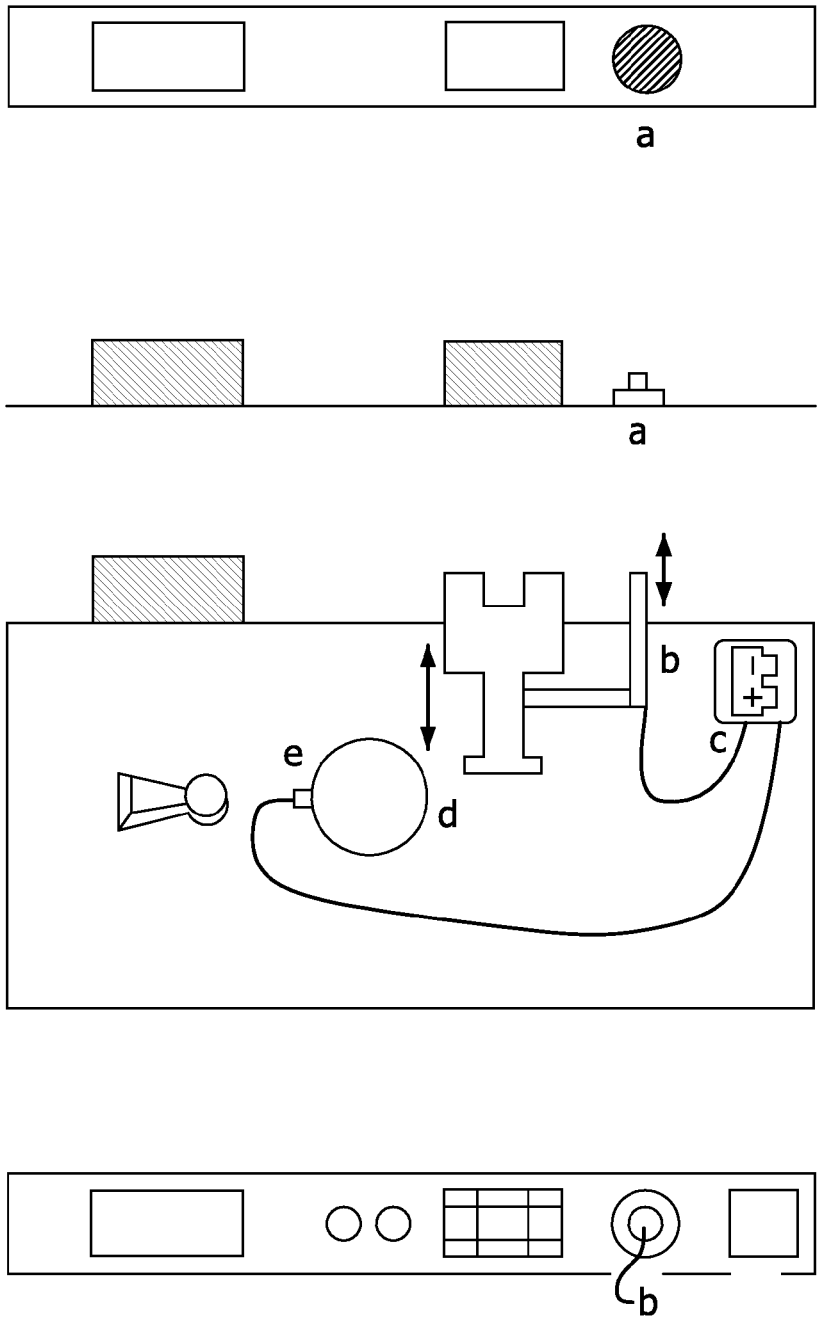

FIG. 4 shows the current cable connected to the latch and to the square axis of the handle The handle 10 has a transparent handgrip or knob 20, sanded if the material utilized requires this to conduct light. At the opposite end to the knob 20, the handle has the usual groove 16 inside which the spindle with definite section and made of metal material which controls the lock 24 (see FIG. 1, not represented in FIGS. 2 and 3) is intended to be fitted in the conventional way. The spindle 8 has an axial through hole inside which the insulating sleeve 9 is inserted. The insulating sleeve 9 also has an axial through hole so that the conductor 4 of the spindle 8 is inserted into it and in this way remains electrically insulated from the spindle 8. Two spring tips 6 are provided at the two ends of the conductor 4 to supply electrical contact to the two handles 10 of the lock (only one handle is represented schematically in the figure).

The spindle 8 can have spring tips positioned at the ends of the spindle 8, in order to make the spindle 8 "telescopic" to adapt it to any different lengths of the spindles due to different thicknesses of the doors. Inserted into the groove 16 of the handle 10 is an insulating button 7, positioned inside which is the conductor 3 intended to make contact with the spring tip 6. Fixed to the other end of the conductor 3 is the conductor wire of the LED or luminous source of any type positioned in the knob 20.

The handle 10 has a through hole for the electric connection on one side to the handgrip or knob 20 and on the other, through the wire 1, to the conductor 3. In the point in which the handle 10 houses the handgrip or knob 20, the handle 10 can have a chamber in which the LED or other luminous source and the relative circuit are housed. The LED or other luminous source can be mounted so that it projects by a few millimetres beyond the handle 10 in order to improve the diffusion of light on the handgrip or knob 20.

In this way the LED or luminous source of any type housed in the handle 10 is placed in electrical contact with the conductor 4.

To be able to carry the electrical current required to supply the LED or luminous source of any type it is in turn necessary to supply the conductor 4 positioned inside the spindle 8. For this purpose the use of the fixing screw 12 is proposed, which in conventional handles or locks can be used to fix the spindle 8 so that it does not slide transversely to the handle. The fixing screw 12 is made of metal material and is provided internally with a cavity into which the insulation 14 is inserted; this in turn supports, internally and consequently insulated from the fixing screw 12, the conductor 18 of the screw 12. The tip of the screw 12, which is intended to make contact with the conductor 4 of the spindle 8, is in electrical contact with the conductor 18. Therefore, once the screw is tightened, electrical contact will be established between the power/data input 2 and the conductor 4 and on the other hand between the external mass of the spindle 8 and of the screw 4.

In place of the fixing screw 12, according to the present invention, a spring ball can be utilized to guarantee the required electrical contact and mechanical stability.

The lock has a latch (not shown) inside which the spindle 8 passes and establishes electrical contact with the spindle 8 by making the current pass from the lock through the latch to the spindle 8.

According to another embodiment of the invention (FIG. 4) the current cable 3 is connected to the latch d. The latch shows a hole with an insulating sleeve. The cable has at its end a fixing screw e which is fixed on the latch d, so that when the square axis of the handle engages the latch, the contact g positioned in the middle of the spindle, is put in contact with the spring e, which reaches its position by means of the incision on the spindle at the central groove of insulating material. The spindle has an axial through hole insulated with an insulating sleeve.

Another possibility provided for by the present invention is that the LED or other luminous source can be positioned in the latch and that the spindle has optical fibres inside it. The light therefore passes through the optical fibres positioned inside the spindle (8) and the handle (10). This solution is extremely suitable for cases in which there is considerable dispersion of light.

At the external end thereof, the conductor 18 of the screw 12 is connected to the power supply of the current through the power/data input connection 2.

As will be discussed in greater detail hereunder, it must be noted that it is possible to connect only the current required to supply the LED or luminous source of any type to the power/data input connection 2, or also a whole series of coded signals capable of managing control of the LED or luminous source of any type. This control can, for example, regulate the colour of the LED or luminous source of any type or carry any other signal useful to indicate different situations of the state of the door. In this way, the user of the handle according to the invention can, with an electronic device, which can be of the type similar to a remote control, indicate with different colours of the handle whether he/she is available to receive people, for example by varying the colour of the knob from green to red. In place of the remote control it would be possible, for example, to provide a button on the door or a switch on the front spindle of the lock.

The spindle 8 and the fixing screw or spring ball 12 are integral with each other with the lock and therefore with the door. This means that once the current or electrical signal is connected to the power/data input connection 2 it will reach the LED or luminous source of any type. In this way we have built an electrical circuit for LED or luminous source of any type, which starts from the power/data input connection 2, passes through the conductor 4, through the latch of the lock, through the wire 1, through the LED or luminous source of any type and returns through the mass formed by the handle 10, the spindle 8 and the lock 24.

Any type of solution can be used to supply the power/data input connection with current or an electrical signal, such as batteries inside the door, network current with relative transformer and rectifier if necessary positioned inside the door.

As already said, the solution with batteries is not a desirable solution where reliable use and relatively high powers are required. With regard to the solution with the network current and relative transformer, positioned inside the door or elsewhere, a flexible mains cable is provided between the door support and the door itself, capable of supplying the transformer even in dynamic conditions of the door which must open and close, in its working life, a great number of times.

It is clear that although being easy to produce, this solution has high risks of accidents linked to the high voltage (220 volts or 110 volts) and to the need to have, as observed above, a flexible electrical connection, therefore liable to be broken or at least damaged with consequent risks of electrical shocks for users. If the transformer is positioned on the outside of the door, this solves the problem of high voltage at the level of the flexible cable between the door support and the door itself, but not the problem related to the duration of the flexible cable which, after a certain number of opening and closing operations of the door, will unavoidably become damaged or broken.

Figure 1:
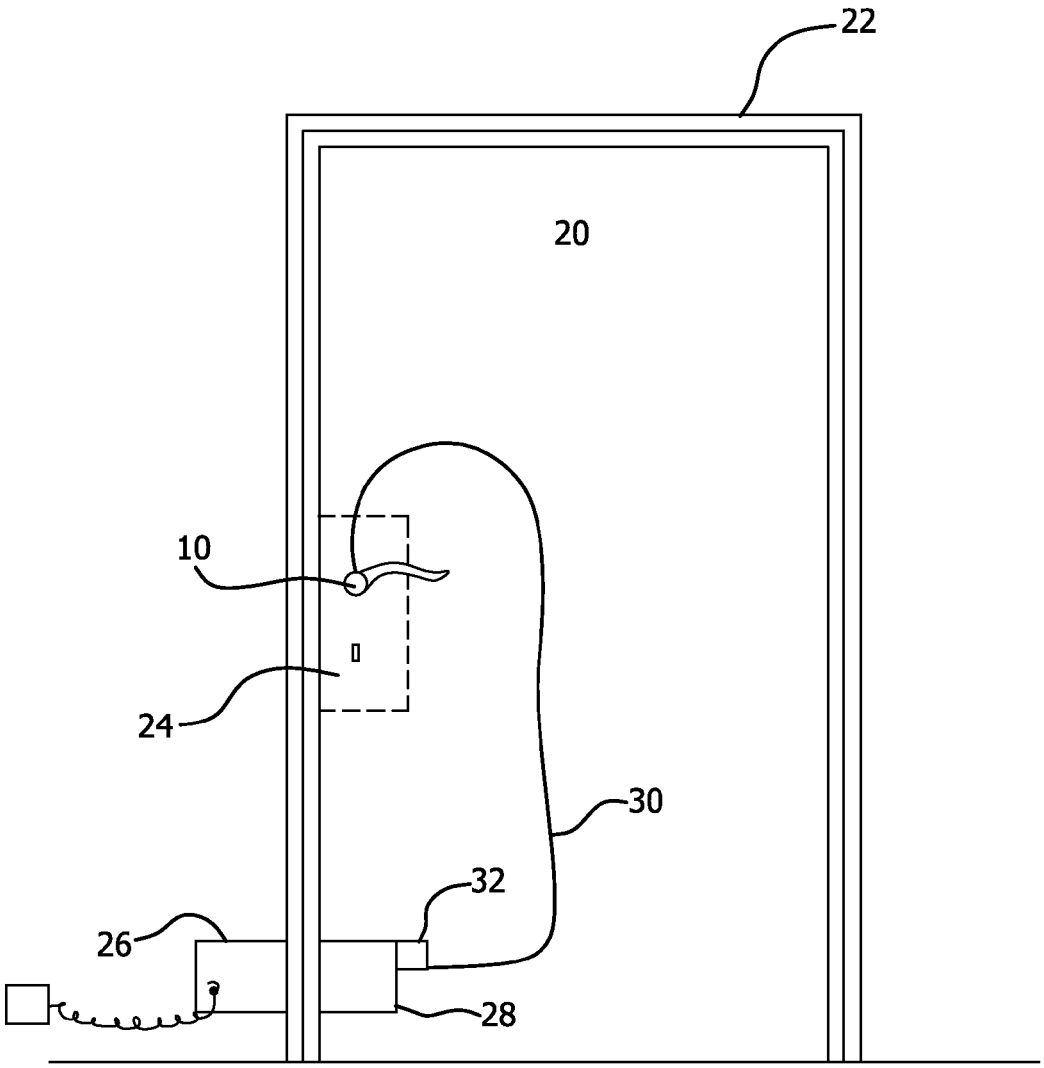

The present finding solves the above problems with a solution of the induction type. With reference to FIG. 1, it can be seen that the primary 26 is connected to the network at 220 or 110 volts and preferably fixed to the inside of the wall or of the frame 22 of the door 20. The secondary 28, integral with the door, preferably positioned inside said door or in the lock so that it is not visible from the outside, is connected to the rechargeable batteries 32 which supply the handle 10 through the electrical cable 30. It is clear that with this solution there are no electrical parts in movement and therefore there is no risk of electrical parts breaking even with intensive use of the door, and moreover the batteries do not require to be replaced frequently.

The only insignificant movement is due to the fact that, as the cable 30 is integral with the lock through the latch, and as said latch is operated by the handle 10 through the spindle 8, with the rotational movement through approximately 30° of the handle the cable also oscillates. This movement is very limited and therefore the duration of the electrically powered system is not endangered.

The unit 26/28 therefore acts as a transformer having the primary 26 and the secondary 28 as circuits. For induction between primary and secondary, voltage to the secondary 28 is created and is reduced, on the basis of the relative number of coils between primary and secondary exactly as in a normal transformer. The voltage is produced to the secondary 28 only when primary and secondary 28 are positioned in front of each other, i.e. with the door closed. It must be considered that the door does not always remain closed and therefore, in order to constantly supply the luminous handle 10 with electrical power, a battery charger block and a system of rechargeable batteries 32 are provided at the output of the secondary 28. In this way the batteries will be recharged constantly when the door is closed and will be able to supply power to the handle even when the door is open. In order to keep the door closed as much as possible a conventional automatic closing system of the door can be provided.

The unit 26/28 could also be positioned in other points of the door 20, such as at the level of the hinge axis or on the lintel of the door 20. The innovative characteristics of the power supply system described above, although being part of the embodiment of the luminous handle of a door according to the present finding, are described with greater detail and claimed in another patent application by the same applicant. The solution proposed by the present invention therefore solves the aforesaid problems.

From the description it is evident that the device in question is composed of very simple elements which are easily available on the market or easily produced, easily executed and easily installed, adaptable to any type of door and with few moving parts.

A further advantage of the present invention lies in the fact that it can also be used for existing systems or locks, thus solving the problem of retrofitting of existing handles and doors. In other words, if one wishes to change an old handle with a new luminous one, it is not necessary (although, of course, possible) to purchase and replace the complete lock with the luminous handle, but only a few components. Thanks to the fact that the spindle and the screw produced according to the invention have the external dimensions of conventional spindles and screws, it is therefore sufficient to replace only the handle with the luminous handle and, naturally, the screw and spindle, leaving all the other components of the lock in use in place. This ensures low costs for the user and facilitates the operation, which can be thus even also be performed by unskilled persons.

The only other operations to be performed refer to the fact that the latch must also be perforated and the housing for the battery and battery charger produced in the door, for example, under the lock or in another point of the door.

As already mentioned, not only an electrical current capable of illuminating the LED or luminous source of any type, but also a series of electrical signals can be transmitted to the conductor 4 and then to the handle 10, by choosing different frequencies of use.

The use of a single conductor to distribute more than one electrical value is well known in the electronic and motor vehicle industries, to name but a few cases. This possibility is particularly useful also for the luminous handle of the present invention, since numerous embodiments can be implemented related to the possibility of providing, at the level of the door, different information and signals. For example, the colour of the knob of the handle could be varied in different moments (office occupied, empty) or luminous spindles with different messages according to the various needs (office hours, communications of any type, or luminous doors, shielded doors, etc.) could be mounted on or inside the door. The availability of electrical signals also leads us to consider the possibility of electrically controlling various other accessories of the door, such as the lock, timed opening and closing of the door using magnetic cards or transponders. Presence sensors could be located and the door made to react with these sensors. There are unlimited possibilities, including, by way of example, an acoustic buzzer with proximity sensor for the visually impaired. Therefore, there are innumerable applications which depend only on contingent needs and are all made possible by the embodiment of the present invention. The present invention could also use ultraviolet LEDs with germicide action for the handle which has innumerable applications, for example in airports, public places, toilets, hospitals, etc. Moreover, all the elements are produced so that they can be offered to the public in the form of a "assembly kit", in order to contain the installation costs, as said installation can be carried out simply and therefore without requiring the use of special tools.

It is understood that different variants can be made to the device forming the subject matter of the present invention without however departing from the scope of the description hereinbefore and the claims hereunder with reference to the accompanying drawings, and therefore from the domain of protection of the present industrial design right.

The invention claimed is:

1. A luminous handle for doors comprising: a handgrip or knob made of transparent or translucent material; a spindle configured to be inserted in a lock, the lock comprising a latch inside which said spindle passes; and a fixing screw or spring ball fixed on said spindle, wherein said spindle has an axial through hole positioned inside of which is a conductor insulated from said spindle through an insulating sleeve and said handgrip or knob or said handle or said lock contains an LED or a luminous source of any type;

the conductor is electrically conductive, the conductor is electrically insulated from said spindle, and supplies said LED or luminous source positioned in said handgrip or knob or in said handle; and said handle has a groove configured to engage said spindle, inside which is fixed insulation which supports an electric conductor cable connected to said LED or luminous source of any type and a second conductor configured to make contact with said spindle; and said electric conductor or said spindle has two spring tips at the two ends thereof, at the level of the ends of the spindle.

2. A luminous handle for doors comprising: a handgrip or knob made of transparent or translucent material; a spindle configured to be inserted in a lock, the lock comprising a latch inside which said spindle passes; and a fixing screw or spring ball fixed on said spindle, wherein said spindle has an axial through hole positioned inside of which is a conductor insulated from said spindle through an insulating sleeve and said handgrip or knob or said handle or said lock contains an LED or a luminous source of any type;

the conductor is electrically conductive, the conductor is electrically insulated from said spindle, and the conductor supplies power to said LED or luminous source positioned in said handgrip or knob or in said handle; and said handle has a groove configured to engage said spindle, inside which is fixed insulation which supports an electric conductor cable connected to said LED or luminous source of any type and a second conductor configured to make contact with said spindle; and said electric conductor comprises a spring configured to make electrical contact with said electric conductor cable and to vary the length of said spindle in order to adapt its length to different thicknesses of said door.

3. A luminous handle as claimed in claim 1, wherein said fixing screw is threaded on the latch of the lock, said fixing screw is configured to be screwed on said spindle which supports a central conductor, said fixing screw comprises insulation, and a connection is provided at external ends of the spindle for input of an electrical signal.

4. A luminous handle according to claim 1, wherein a spring ball is threaded on the latch of the lock, said spring ball is configured to be engaged on said spindle and wherein the thread of the latch includes insulation, and a connection is provided at external ends of the spring ball for input of an electrical signal.

5. A luminous handle as claimed in claim 3, wherein an electrical current is distributed to said connection for input of the electrical signal to supply said LED or luminous source of any type.

6. A luminous handle as claimed in claim 3, wherein a modulated electrical signal to control said LED or luminous source of any type, or an information display, or for any other control of said lock, is distributed to said connection for input of an electrical signal.

7. A luminous handle as claimed in claim 1, wherein electric current to supply said LED or luminous source of any type is obtained by an induction system.

8. A luminous handle as claimed in claim 7, wherein said induction system comprises a primary connected to the electrical network and fixed inside a wall or a frame of the door and a secondary, integral with the door and positioned inside the door or inside said lock so that it is not visible from the outside, said secondary being configured to recharge rechargeable batteries which supply the handle through an electric cable.

9. A luminous handle as claimed in claim 1, wherein said LED or luminous source of any type is positioned in said latch of said lock and optical fibers which transport the light to said handgrip or knob are positioned inside said spindle.

10. A luminous handle as claimed in claim 1, wherein electrical current for said LED or luminous source is obtained from a system which is in electro-mechanical contact with a mobile part of the lock, said contact recharging rechargeable batteries which supply the handle by means of an electrical cable.

11. A luminous handle as claimed in claim 10, wherein the electro-mechanical contact occurs between a striker plate on a frame of the door and a non-centered contact on the mobile part of the lock, and wherein a contact head on the mobile part comprises a spring contact.

12. A luminous handle as claimed in claim 10, wherein a servo-lever set in action by the mobile part of the lock engages a striker plate on the door frame when the door is closed, thereby compressing a contact on the striker plate to the non-centered contact on the mobile part of the lock.

13. A luminous handle as claimed in claim 4, wherein an electrical current is distributed to said connection for input of the electrical signal to supply said LED or luminous source of any type.

14. A luminous handle as claimed in claim 4, wherein a modulated electrical signal to control said LED or luminous source of any type, or an information display, or for any other control of said lock, is distributed to said connection for input of an electrical signal.

15. A luminous handle as claimed in claim 1, wherein electric current to supply said LED or luminous source of any type is obtained by an induction system.

16. A luminous handle as claimed in claim 15, wherein said induction system comprises a primary connected to the electrical network and fixed inside a wall or a frame of the door and a secondary, integral with the door and positioned inside the door or inside said lock so that it is not visible from the outside, said secondary being configured to recharge rechargeable batteries which supply the handle through an electric cable.

17. A luminous handle as claimed in claim 1, wherein electrical current for said LED or luminous source is obtained from a system which is in electro-mechanical contact with a mobile part of the lock, said contact recharging rechargeable batteries which supply the handle by means of an electrical cable.

18. A luminous handle as claimed in claim 17, wherein the electro-mechanical contact occurs between a striker plate, a frame of the door and a non-centered contact on the mobile part of the lock, and wherein a contact head on the mobile part comprises a spring contact.

19. A luminous handle as claimed in claim 17, wherein a servo-lever set in action by the mobile part of the lock engages a striker plate on the door frame when the door is closed, thereby compressing a contact on the striker plate to the non-centered contact on the mobile part of the lock.

20. A luminous handle as claimed in claim 2, wherein said fixing screw is threaded on the latch of the lock, said fixing screw is configured to be screwed on said spindle which supports a central conductor, said fixing screw comprises insulation, and a connection is provided at external ends of the spindle for input of an electrical signal.

21. A luminous handle according to claim 2, wherein a spring ball is threaded on the latch of the lock, said spring ball is configured to be engaged on said spindle and wherein the thread of the latch includes insulation, and a connection is provided at external ends of the spring ball for input of an electrical signal.

* * * * *